US007360313B1

(12) United States Patent
Hamm et al.

(10) Patent No.: US 7,360,313 B1
(45) Date of Patent: Apr. 22, 2008

(54) GEARED ARCHERY BOW SIGHT APPARATUS

(76) Inventors: Harold M. Hamm, 7222 Townline Rd., Wisconsin Rapids, WI (US) 54494; Christopher A. Hamm, 7222 Townline Rd., Wisconsin Rapids, WI (US) 54494; Brian H. Hamm, 7222 Townline Rd., Wisconsin Rapids, WI (US) 54494

( * ) Notice: Subject to any disclaimer, the term of this patent is extended or adjusted under 35 U.S.C. 154(b) by 8 days.

(21) Appl. No.: 11/593,614

(22) Filed: Nov. 7, 2006

(51) Int. Cl.
*F41G 1/467* (2006.01)

(52) U.S. Cl. ..... 33/265; 124/87

(58) Field of Classification Search ..... 33/265; 124/87, 88
See application file for complete search history.

(56) References Cited

U.S. PATENT DOCUMENTS

| | | | | |
|---|---|---|---|---|
| 4,567,668 | A * | 2/1986 | King et al. | 33/265 |
| 5,092,052 | A * | 3/1992 | Godsey | 124/87 |
| 5,092,053 | A * | 3/1992 | Roberts | 33/265 |
| 5,511,317 | A * | 4/1996 | Allen | 33/265 |
| 5,651,185 | A * | 7/1997 | Vanderheyden et al. | 33/265 |
| 5,718,215 | A * | 2/1998 | Kenny et al. | 124/87 |
| 5,920,996 | A * | 7/1999 | Hurckman et al. | 33/265 |
| 6,061,919 | A * | 5/2000 | Reichert | 33/265 |
| 2002/0100177 | A1 * | 8/2002 | Savage | 33/265 |
| 2003/0056379 | A1 * | 3/2003 | Johnson et al. | 33/265 |

* cited by examiner

*Primary Examiner*—G. Bradley Bennett
(74) *Attorney, Agent, or Firm*—John Richardson

(57) ABSTRACT

Rotation of the cylindrical handle rotates the geared sprocket which biases the linear slide member, which selectively raises and lowers the cylindrical bow sight housing. A locking knob releasably secures the cylindrical handle during rough handling. The cylindrical bow sight includes a circular ring on the front face of the circular bow sight housing, and a bubble level provides a level indication. A fiber optic sight is centered in the bow sight housing in optical communication with a fiber optic band to improve the visibility of the bow sight in low light conditions. A sliding keyway and adjustment screw adjusts the cylindrical bow sight elevation. Indicia on the cylindrical handle provides alignment data responsive to the position of the cylindrical bow sight in relation to the distance to a remote target.

20 Claims, 5 Drawing Sheets

GEARED ARCHERY BOW SIGHT APPARATUS

CROSS REFERENCE TO RELATED TOPICS

Not Applicable

STATEMENT REGARDING FEDERALLY SPONSORED RESEARCH OR DEVELOPMENT

Not Applicable

REFERENCE TO SEQUENCE LISTING A TABLE, OR A COMPUTER PROGRAM LISTING COMPACT DISK APPENDIX

Not Applicable

BACKGROUND OF THE INVENTION

1. Field of the Invention

This invention relates to a geared bow sight for archery, and more particularly to a geared linearly adjustable archery bow sight.

2. Background of the Invention

Vertically adjustable bow sights are known to adjust for trajectory of the arrow in response to the distance to the target. Some of these devices utilize a trial and error adjustment means, which are tested and adjusted by the user in response to actual field use. The bow sights typically utilize scale or distance marks to estimate the distance adjustment required to reach the target. Distance adjustments vary by the bow type, the draw strength, the target elevation, the target distance, wind conditions, terreign elevation, etc.

U.S. Pat. No. 5,975,069 issuing to Harold M. Hamm et al. on Nov. 2, 1999, discloses an archery bow sight apparatus, which has a fiber optic bow sight mounted in an elongated housing, and is adjustably positioned by manually moving a cam member to raise or lower the bow sight in response to the distance of the user from the target. The bow sight housing is not adjustable to accommodate various bow thickness configurations; and gears are not used to precisely position and maintain the cam member in position during use. A large block of light absorbing material is used to intensify the light received by the fiber optic bow sight.

U.S. Pat. No. 5,092,052 issuing to Samuel Godsey on Mar. 3, 1992 utilizes a linear track on the mounting plate and a complimentary linear track on the rear edge of the sight plate. A slot is required in the sight plate to compensate for the arcuate movement of the adjustable arm. The linear track is subject to jamming in the presence of particles and debris that become lodged in the track.

U.S. Pat. Nos. 4,109,179; 4,418,479; 4,497,116 and 4,541,179 each utilize a form of quadrilateral linkage to obtain linear movement of the bow sight.

Other U.S. patents relating to adjustable bow sights include, for example, U.S. Pat. Nos. 2,642,661; 2,667,692; 3,318,298; 4,473,959; 4,567,668; 4,977,677; and 4,986,001.

Thus, what is needed is a geared archery bowsite, which is linearly responsive to adjustment by the user, by rotating a cylindrical handle portion, with a locking knob positioned adjacent to the cylindrical handle portion to reliably secure the elevated position of the bowsite in relation to the bow. The cylindrical handle portion further has indicia about its outer periphery for identifying the distance from the bowsite to the target. The geared archery bowsite is rugged in contruction, yet simple in operation, is viewable in a variety of light conditions, is compact in design, light weight, and does not interfere with the operation of the bow or its user during normal hunting or target conditions.

The above mentioned and other features and objects of the invention, and the manner of attaining them will be best understood by reference to the following description of an embodiment of the invention, when considered in conjunction with the accompanying drawing:

BRIEF SUMMARY OF THE INVENTION

Accordingly, it is an object of the present invention to provide a geared archery bow sight apparatus, that addresses these needs.

It is another object of the present invention to provide a rotatable cylindrical handle portion for ease of linearly adjusting the elevation of the bow sight apparatus to correspond to the distance to a target.

It is still another object of the present invention to provide a locking knob to releasably secure the geared cylindrical handle portion in place during use and while traversing difficult terreign.

It is yet another object of the present invention to provide a circular sighting ring on the front face of the fiber optic bow site to improve visual alignment of fiber optic sight in relation to the target, in varying light conditions.

It is still another object of the present invention to provide a fiber optic light gathering ring extending about the outer periphery of the cylindrical bow sight housing, wherein the light gathering ring is in optical communication with the fiber optic bow sight centered within the cylindrical bow sight housing.

It is a further object of the present invention to adjustably position the bow sight mounting bracket to the cylindrical bow sight housing to accommodate various bow sizes and styles.

It is also an object of the present invention to provide two spaced linear grooves in the linear slide member, with first and second guide bushings slidably received in the first linear groove, and a third guide bushing slidably received in the second linear groove, to improve precise linear adjustment of the bow site in relation to movement of the cylindrical handle.

It is still another object of the present invention to provide a fourth guide bushing slidably received in a transverse slot located in the linear slide member, and to precisely position the fourth guide bushing to eliminate play between the linear slide member and the articulated cam member.

It is yet another object of the present invention to provide indicia on the outer periphery of the cylindrical handle to identify the elevation of the bow sight mounting bracket in relation to the distance to a target.

The above mentioned and other features and objects of the invention, and the manner of attaining them will be best understood by reference to the following description of an embodiment of the invention, when considered in conjunction with the accompanying drawings:

DETAILED DESCRIPTION OF THE INVENTION

Figure 1:
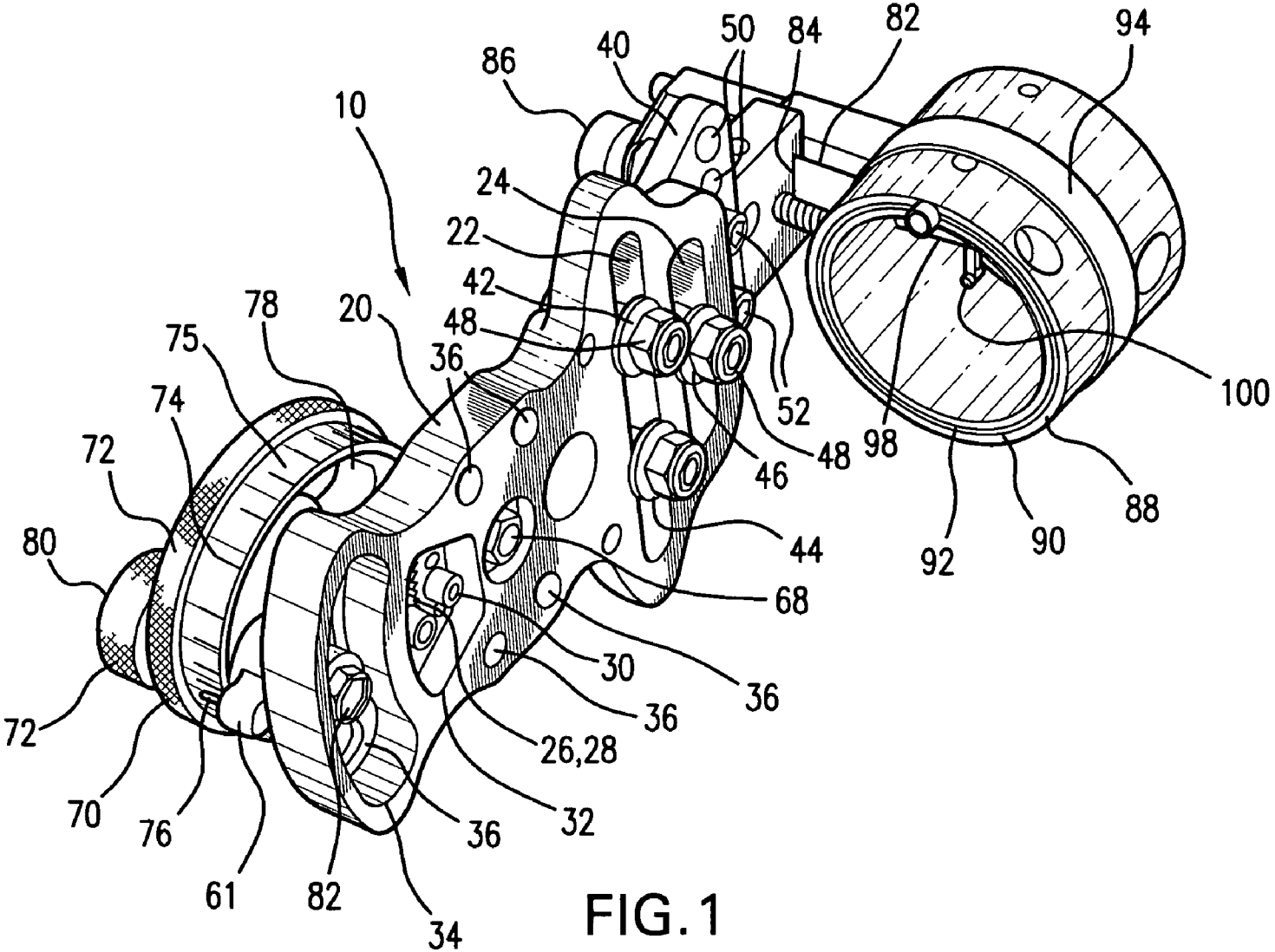
FIG. 1 is a perspective view of the assembled geared archery bow sight apparatus with the articulated cam member positioned on-center, prior to installing the geared archery bow sight apparatus on a bow.
Figure 2:
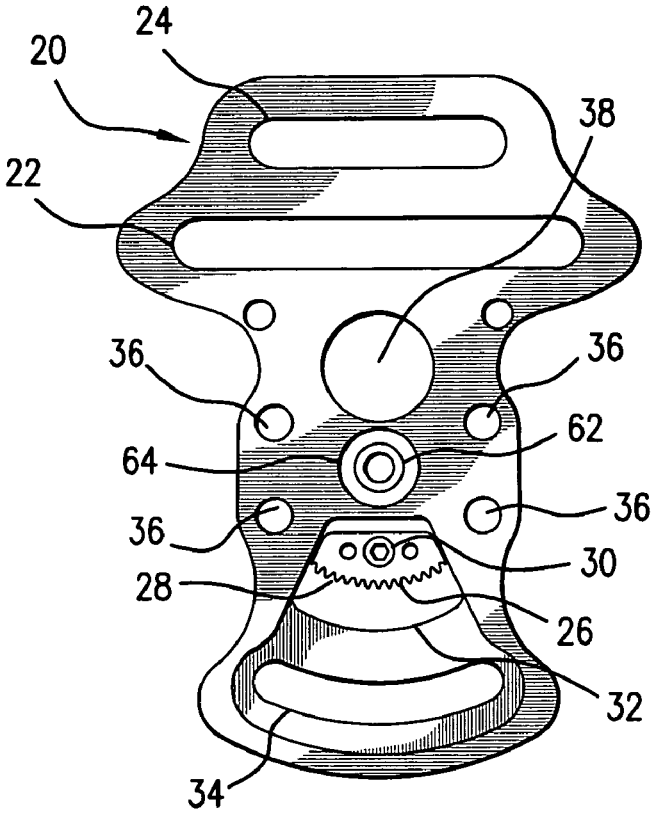
FIG. 2 is a detailed view of the mounting frame member.

The geared archery bow sight apparatus 10, as shown in FIG. 1 through FIG. 7, shows the geared archery bow sight apparatus 10 of the present invention. As shown in FIG. 2, the mounting frame member 20 has a first linear slot 22, with a second linear slot 24 in spaced parallel alignment with the first linear slot 22. One or more lightening holes 38 extend through the mounting frame member to reduce the weight of the geared archery bow sight apparatus 10. A convex gear member 26 with a plurality of fixed teeth 28 is secured in a gear aperture 32 provided in the mounting frame member 20. The convex gear member 26 is preferably secured to the mounting frame member 20 with a suitable screw 30, or other known fastening means. A rotatable gear sprocket 66 engages the fixed teeth of a convex gear member 26, as disclosed in further detail herein.

As shown in FIG. 1, the linear slide member 40, is adjustably positioned in relation to the mounting frame member 20 by a first and a second slidable guide bushings 42, 44 sized to be slidably received within the first linear slot 22. A third slidable guide bushing 46 is sized to be slidably received within the second linear slot 24. The third guide bushing 46 is preferably slightly offset from center, providing a cam action to precisely position the third guide bushing 46 in the second linear slot 24, eliminating tolerance concerns. The guide bushings 42, 44, 46 are preferably made of a low friction material, such as teflon, nylon, or other suitable plastic material. Any low friction material known in the art may be used, without departing from the scope of this disclosure, or the accompanying claims. The guide bushings 42, 44, 46 are each secured to the linear slide member 40 with a fastening means 48, such as with a suitable screw and nut.

Figure 3:
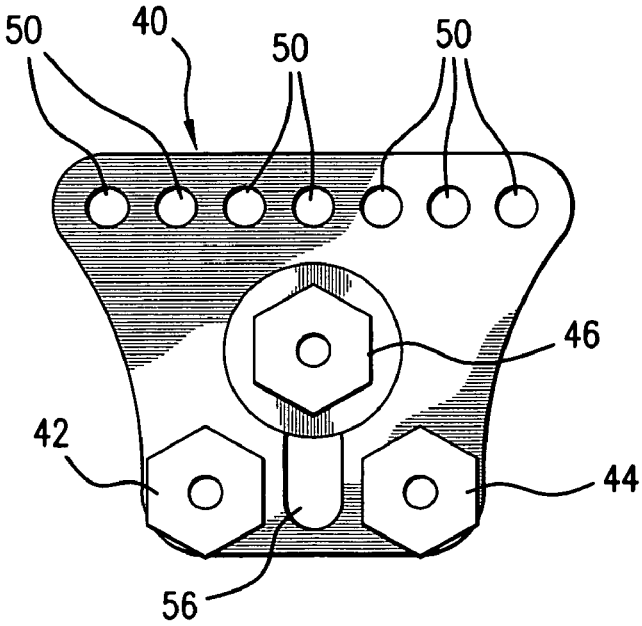
FIG. 3 is a detailed view of the linear slide member.

As shown in FIG. 3, the linear slide member 40 has a plurality of spaced apertures 50 positioned to adjustably receive suitable fasteners 52 to secure the optical mounting bracket 54 to the linear slide member 40. The plurality of spaced apertures 50 provide a macro adjustment for locating the cylindrical bow sight housing 90 to the linear slide member 40 in one of several locations. A transverse slot 56 is positioned in the linear slide member 40 between the first and second slidable guide bushings 42, 44. The transverse slot 56 is sized to receive a fourth guide bushing 58 therein. The fourth guide bushing 58 is secured in proximity to the second end 59 of the articulated cam member 60, and extends at assembly into the transverse slot 56.

Figure 4:
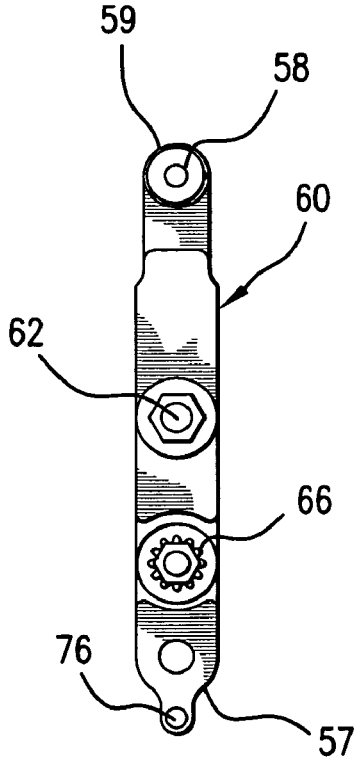
FIG. 4 is a detailed view of the articulated cam member.

The fourth guide bushing 58 is secured near the distal end 59 of the articulated cam member 60, as shown in FIG. 4. The central portion of the articulated cam member 60 is pivotally secured by a suitable fastening means 62 to a suitable cam aperture 64 located in the mounting frame member 20. The articulated cam member 60 also has a rotatable geared sprocket 66 which is positioned to engage the fixed teeth 28 on the convex gear member 26 within the enlarged aperture 32 provided in the mounting frame member 20. A fastener 68 extends through the rotatable geared sprocket 66, and through the articulated cam member 60 to engage a rotatable cylindrical handle 70. When the cylindrical handle 70 is rotated, the geared sprocket 66 also rotates, moving the articulated cam member 60, which in turn moves the linear slide member 40, to adjustably position the optical mounting bracket 54. The geared sprocket 66 maintains the adjusted position of the linear slide member 40, and assures precise alignment during use.

Figure 5A:
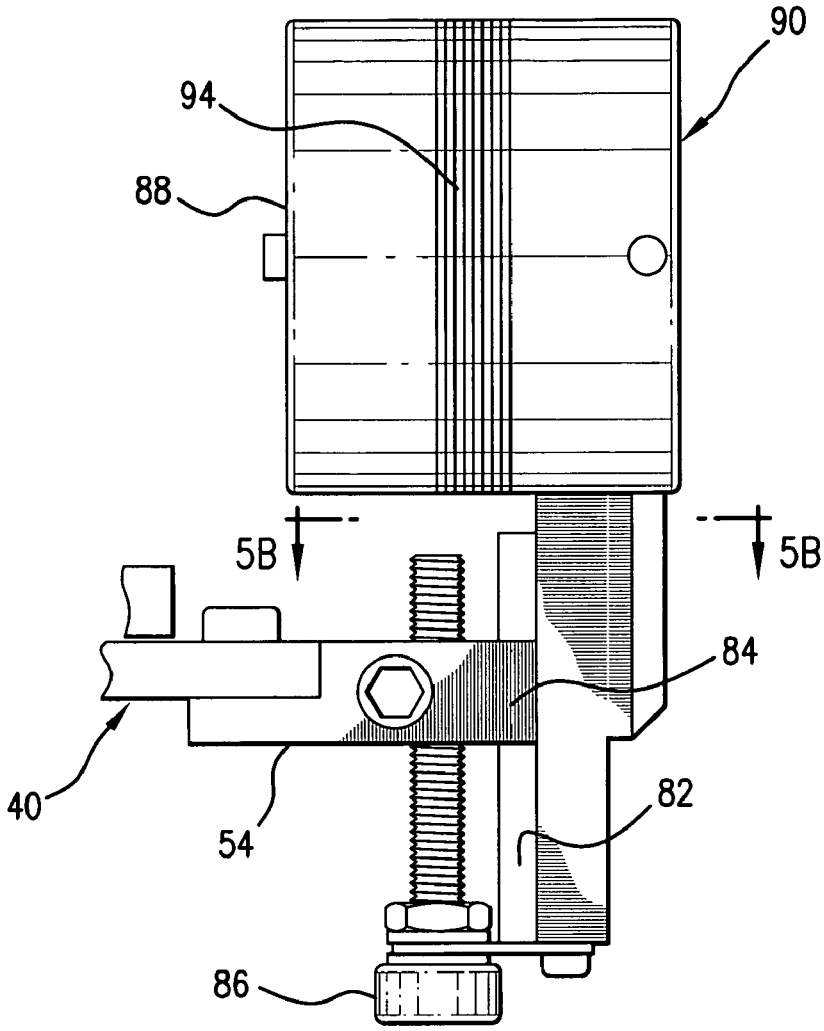
FIG. 5A is a partial side view of the cylindrical bow sight housing showing the sliding keyway and screw used to adjust the position of the cylindrical bow housing in relation to the mounting frame member.

FIG. 5A is a partial side view of the cylindrical bow sight housing 90, showing the cylindrical bow sight housing 90 mounted to a sliding keyway 82 which engages a complimentary keyway 84 secured to selected apertures 50 on the optical mounting bracket 54. An adjustment screw 86 is threaded through the optical mounting bracket 54 to bias the position of the cylindrical bow sight housing 90 in relation to the optical mounting bracket 54. This adjustment allows the user to adjust the position of the cylindrical bow sight housing 90 in relation to the mounting frame member 20, to accommodate different bow sizes and styles (not shown).

Figure 5B:
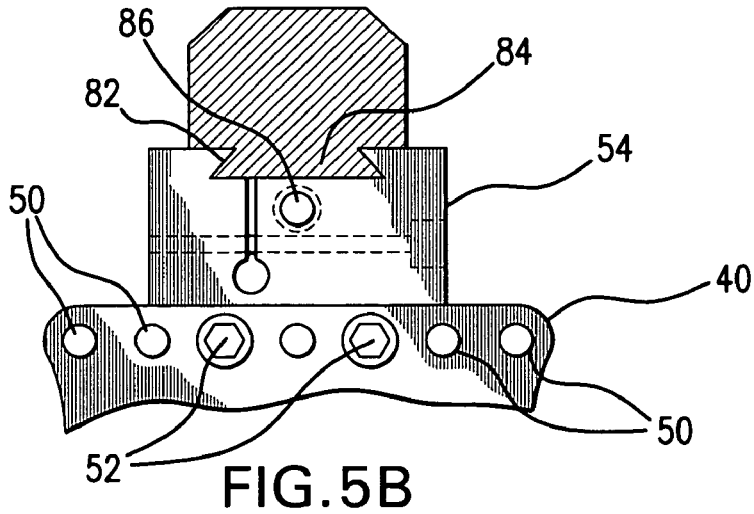
FIG. 5B is a cross sectional view of the keyway taken along lines 5B-5B in FIG. 5A.

FIG. 5B is a cross sectional view of the sliding keyway 82 and the complimentary keyway 84 taken along lines 5B-5B in FIG. 5A. As the complimentary keyway 84 is biased by the adjustment screw 86, the complimentary keyway 84 slidably engages the sliding keyway 82 to adjustably position the cylindrical bow site housing 90 in relation to the optical mounting bracket 54.

Figure 6:
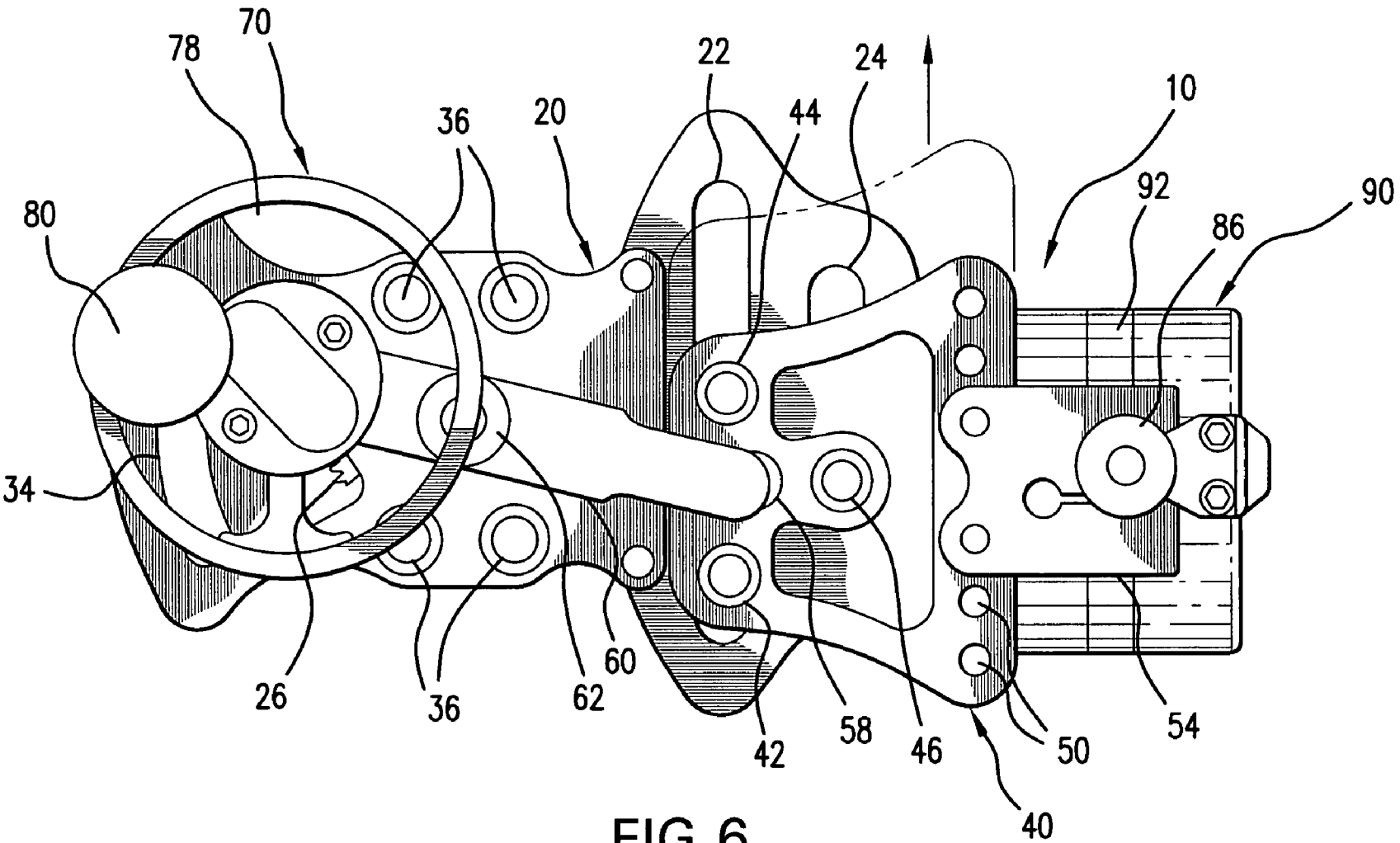
FIG. 6 is a bottom assembly view of the bow sight apparatus with the articulated cam member positioned off-center, as shown from the opposite side of FIG. 1.
Figure 7:
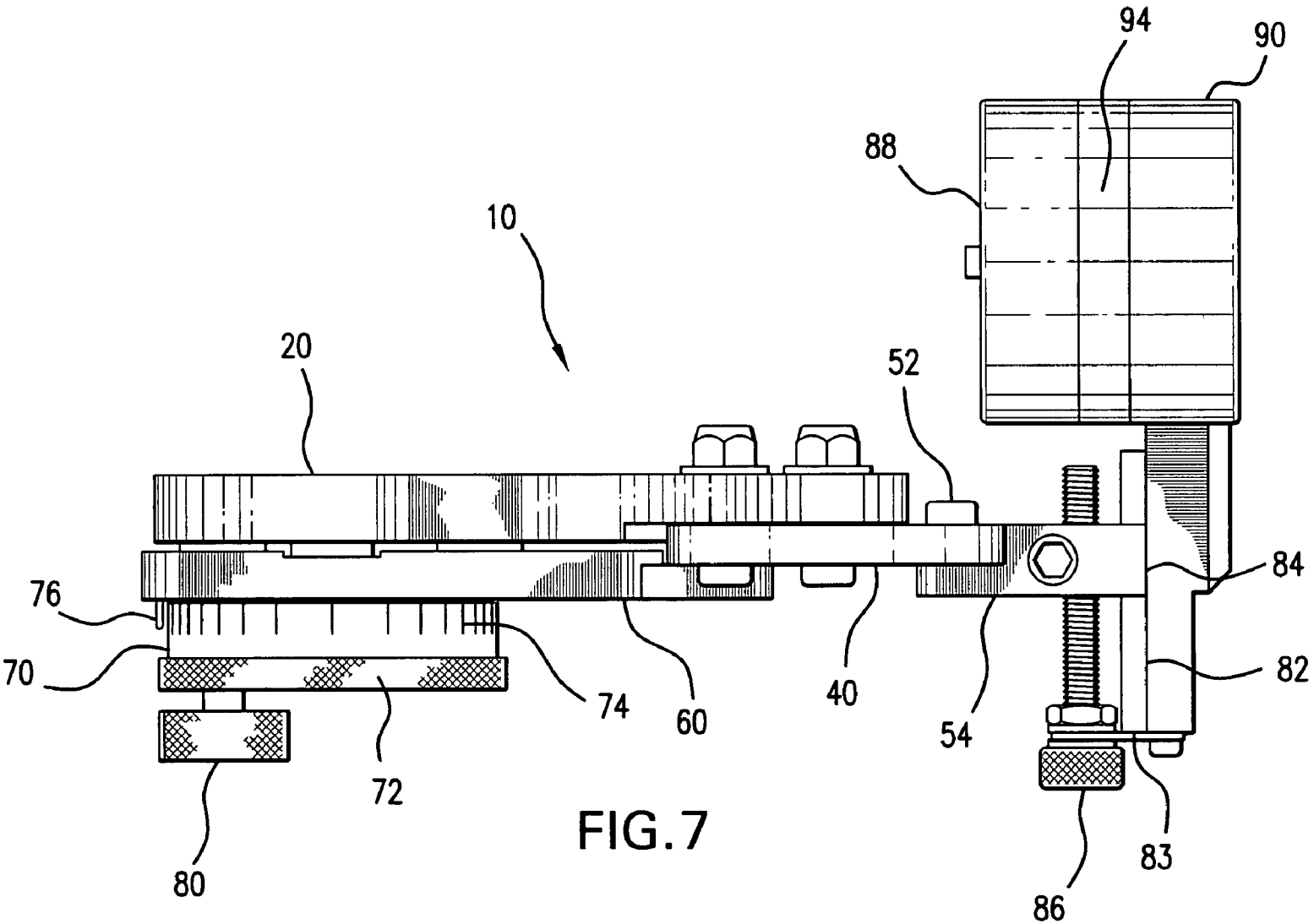
FIG. 7 is a side view of the assembled geared archery bow sight apparatus shown in FIG. 1.

A cylindrical handle 70 is best shown in FIG. 6, where the cylindrical handle 70 has been rotated to bias the articulated cam member 60, which moves the linear slide member 40 to adjust the height of the cylindrical bow sight housing 90. The cylindrical handle 70 includes an arcuate aperture 78 positioned to allow movement of the cylindrical handle 70 in relation to a locking knob 80 extending through the arcuate aperture 78. The locking knob 80 is preferably knurled 72 about a portion of the outer periphery, for ease of rotating the cylindrical handle 70. Markings, or other indicia 74 are preferably placed about a portion of the outer periphery of the cylindrical handle 70 to indicate a distance to a target (not shown). The tip 61 of the articulated cam member 60 preferably includes a pin 76 extending in spaced relation adjacent to a portion of the cylindrical handle 70 in close proximity to the indicia 74, to indicate the distance to a target.

In a preferred embodiment, a printed strip 75 with markings or other indicia 74 thereon is positioned upon the outer circumference of the cylindrical handle 70, and the user test fires an arrow at a target positioned 20 feet from the bow. A second target it then positioned at 60 feet from the bow, and a second arrow is fired. The markings on the printed strip are then compared with the position of the pin 76 in relation to the markings 74, and the difference in the markings is used to determine the spacing required for each of the marks or indicia 74. A second printed strip 75 with suitable spacing is then used, to accurately determine the elevation required to reach a target at a given distance.

A locking knob 80 extends through an arcuate aperture 78 in the cylindrical handle 70, and through the articulated cam member 60, to engage the arcuate recess 34 provided in the mounting frame member 20. The arcuate recess 34 preferably has a step 36 provided to engage the distal end 82 of the locking knob 80. When tightened, the cylindrical handle 70 cannot be easily moved, even during rough handling in the field. When the locking knob 80 is loosened, the cylindrical handle 70 is free to rotate, which adjustably positions the cylindrical bow sight housing 90 to the desired distance from the target.

The optical mounting bracket 54 extends beyond the linear slide member 40 to engage a sliding keyway 82 with a complimentary keyway 84 extending from the cylindrical bow sight housing 90, as best shown in FIG. 5A and FIG. 5B. A threaded screw 86 is rotatably mounted to the sliding keyway 82, and threadably engages the optical mounting bracket 54 to adjustably position the cylindrical bow sight housing 90 to suit various sizes and shapes of bows (not shown).

The cylindrical bow sight housing 90 includes a circular ring of paint 92 mounted about the circular front face 88 of the cylindrical bow sight housing 90, to center the fiber optic bow sight 100 in relation to the circular ring of paint 92, for ease of sighting a target in low light conditions. The cylindrical bow sight housing 90 also includes a fiber optic material 94 extending about the outer periphery of the cylindrical bow sight housing 90. The fiber optic material 94 is in optical communication with the fiber optic bow sight 100, centered in the circular bow site housing 90. The fiber optic sight 100 provides improved visibility in low light conditions, to aid the user in framing the target within the cylindrical bow sight housing 90. A bubble level 98 is also mounted within the cylindrical bow sight housing 90 to aid the user in aligning the bow with the target.

In operation, the geared archery bow sight apparatus 10 is mounted to a user's bow (not shown) in proximity to the bow handle using the mounting apertures 36 provided in the mounting frame member 20, in a position which will not interfere with the normal operation of the bow during the shooting of a suitable arrow (not shown). Suitable fasteners (not shown) extend through the mounting apertures 36 for ease of mounting the geared archery bow sight apparatus 10 to the user's bow.

Once the geared archery bow sight apparatus 10 has been mounted to the user's bow, the user rotates the cylindrical handle 70, which rotates the geared sprocket 66, which acts against the fixed gear teeth 28, to bias the articulated cam member 60, which moves the linear slide member 40 to selectively raise or lower the cylindrical bow sight housing 90. Marking indicia 74 on the cylindrical handle 70 may be used to align with the pin 76, to select the preferred distance to the target, ensuring repetitive results.

The arcuate aperture 78 extending through the cylindrical handle 70 provides rotation of the cylindrical handle 70 in relation to the locking knob 80, as the optical mounting bracket 54 is raised or lowered by rotation of the cylindrical handle 70. The locking knob 80 extends through the arcuate aperture 78 in the cylindrical handle 70, and through the linear slide member 40, and is slidably received in the arcuate recess 34 located in the mounting frame member 20. When the locking knob 80 is tightened by rotation of the locking knob 80, the cylindrical handle 70 and linear slide member 40 are secured to the mounting frame member 20, ensuring a fixed position of the circular bow sight housing 90 during rough handling.

When the locking knob 80 is loosened by rotation of the locking knob 80, the cylindrical handle 70 is free to rotate, which biases the articulated cam member 60, which acts through the geared sprocket 66 and the convex fixed gear member 26 to bias the linear slide member 40 in relation to the mounting frame member 20, to selectively raise or lower the optical mounting bracket 54.

Thus, while a preferred embodiment of the geared archery bow sight apparatus 10 has been disclosed, one of average skill in this art may make numerous changes and modifications without departing from the scope of this invention, and such changes or modifications are intended to fall within the scope of the following claims.

What is claimed is:

1. A geared archery bow sight apparatus, comprising:

(a) a mounting frame member having a first linear slot, a second linear slot in spaced relation parallel to the first linear slot, an enlarged aperture sized to receive a convex fixed gear member therein, and an arcuate recess with a stepped ledge sized to receive a screw head therein;

(b) a linear slide member with first and second bushings slidably received in the first linear slot of the mounting frame member, and a third bushing slidably received in the second linear slot, the linear slide member with an elongated transverse aperture extending between the first and second bushings, and a plurality of apertures sized to receive a suitable fastening means therethrough;

(c) an articulated cam member with an first aperture sized to receive a pivot arm therethrough, the articulated cam member further having a cam bushing extending therefrom near a second end, the cam bushing sized to be closely received in the elongated transverse aperture extending between the first and second bushings extending through the linear slide member, the articulated cam member further having a rotatable geared sprocket extending therefrom, the rotatable geared sprocket sized to engage the fixed teeth of the convex fixed gear member secured within the enlarged aperture in the mounting frame member, and a pin extending from near the first end of the articulated cam member;

(d) a cylindrical handle connected to the geared sprocket through the articulated cam member, the cylindrical handle having an arcuate recess positioned to adjustably receive a locking knob therethrough, the cylindrical handle further having a knurled portion extending about the outer periphery of the cylindrical handle, with indicia located on an unknurled portion of the outer periphery of the cylindrical handle to align with the pin extending from the second end of the articulated cam member;

(e) an optical mounting bracket secured to the linear slide member; and (f) a cylindrical bow site housing adjustably connected to the optical mounting bracket, the cylindrical bow site housing with a fiber optic bow sight centrally mounted therein; wherein rotation of the cylindrical handle, rotates the geared sprocket in relation to the convex fixed gear member, which biases the articulated cam member to slidably bias the linear slide member and the optical mounting bracket, to bias the circular bow sight housing to align the fiber optic sight in relation to the distance to a remote target.

2. The geared bow sight apparatus of claim 1, wherein the cylindrical bow sight housing includes an elongated keyway extending beneath the cylindrical bow sight housing, with a complimentary keyway extending from the optical mounting bracket, with a threaded adjustment screw extending between the distal end of the elongated keyway and the optical mounting bracket to adjustably position the cylindrical bow sight housing in relation to the optical mounting bracket, to suit various sizes and shapes of a user's bow in proximity to the user's bow handle.

3. The geared archery bow sight apparatus of claim 1, wherein the circular bow sight housing has a fiber optic band extending about the outer periphery of the circular bow sight, the fiber optic band in optical communication with the fiber optic bow sight, to intensify the light transmitted by the fiber optic bow sight in low light conditions.

4. The geared archery bow sight apparatus of claim 1, wherein the locking knob is knurled about the outer circumference to aid manual rotation.

5. The geared archery bow sight apparatus of claim 1, wherein the first guide bushing, the second guide bushing, the third guide bushing and the fourth guide bushing are each made of a low friction material.

6. The geared archery bow sight apparatus of claim 1, wherein one or more recesses and lightening holes are provided in the mounting frame member to reduce weight, and wherein one or more recesses and lightening holes are provided in the linear slide member to reduce weight.

7. The geared archery bow sight apparatus of claim 1, wherein a printed strip with indicia thereon is removably secured upon the outer circumference of the cylindrical handle, the indicia positioned on the printed strip to indicate the position required for a selected distance to a remote target.

8. The geared archery bow sight apparatus of claim 1, wherein the mounting frame member, the linear slide member, the articulated cam member and the optical mounting bracket are each made of a suitable aluminum material to reduce weight.

9. The geared archery bow sight apparatus of claim 1, wherein mounting apertures are provided in the mounting frame member in spaced proximity to the pivot pin.

10. The geared archery bow sight apparatus of claim 1, wherein a circular ring element is mounted on the front face of the circular bow sight housing, to provide a circular frame of reference about the fiber optic bow sight.

11. The geared archery bow sight apparatus of claim 1, wherein a leveling bubble is mounted on the upper portion of the circular bow sight housing when the geared archery bow sight apparatus is mounted to a bow, to provide a level indication while sighting through the circular bow sight housing.

12. A geared archery bow sight apparatus, comprising:

(a) a mounting frame member having a first linear slot, a second linear slot in spaced relation parallel to the first linear slot, an enlarged aperture sized to receive a convex fixed gear member therein, and an arcuate recess with a stepped ledge sized to receive a screw head therein, and at least one lightening hole extending through the mounting frame member to reduce the weight of the geared archery bow apparatus;

(b) a linear slide member with first and second bushings slidably received in the first linear slot of the mounting frame member, and a third bushing slidably received in the second linear slot, the first, second and third bushings made of a low friction material, the linear slide member with an elongated transverse aperture extending between the first and second bushings, and a plurality of apertures sized to receive a suitable fastening means therethrough;

(c) an articulated cam member with a first aperture sized to receive a pivot arm therethrough, the articulated cam member further having a cam bushing extending therefrom near a second end, the cam bushing sized to be closely received in the elongated transverse aperture extending into the linear slide member at assembly, the articulated cam member further having a rotatable geared sprocket extending therefrom, the rotatable geared sprocket sized to engage the fixed teeth of the convex fixed gear member secured within the enlarged aperture in the mounting frame member, and a pin extending from near the first end of the articulated cam member;

(d) a cylindrical handle connected to the geared sprocket through the articulated cam member, the cylindrical handle having an arcuate recess positioned to adjustably receive a locking knob therethrough, the cylindrical handle further having a knurled portion extending about the outer periphery of the cylindrical handle, with indicia located on an unknurled portion of the outer periphery of the cylindrical handle to align with the pin extending from the second end of the articulated cam member, the indicia used to indicate the distance to a remote target;

(e) an optical mounting bracket secured to the linear slide member; and (f) a cylindrical bow site housing adjustably connected by a sliding keyway to a complimentary keyway located on the optical mounting bracket, with an adjustment screw to selectively position the cylindrical bow site housing in relation to the optical mounting bracket, with a fiber optic bow sight substantially centered within the cylindrical bow sight housing; wherein rotation of the cylindrical handle, rotates the geared sprocket in relation to the convex fixed gear member, which biases the articulated cam member to slidably bias the linear slide member and the optical mounting bracket, which acts to bias the circular bow sight housing to align the fiber optic sight, in relation to the distance of the geared bow sight apparatus from a remote target.

13. The geared bow sight apparatus of claim 12, wherein the circular bow sight housing has a fiber optic band extending about the outer periphery of the circular bow sight housing, the fiber optic band in optical communication with the fiber optic bow sight, to intensify the light transmitted by the fiber optic bow sight in low light conditions.

14. The geared bow sight apparatus of claim 12, wherein the mounting frame member, the linear slide member, the articulated cam member and the optical mounting bracket are each made of a suitable aluminum material to reduce weight.

15. The geared bow sight apparatus of claim 12, wherein a circular ring element is mounted on the front face of the circular bow sight housing, to provide a circular frame of reference about the fiber optic bow sight.

16. The geared bow sight apparatus of claim 12, wherein a leveling bubble is mounted on the upper portion of the circular bow sight housing when the geared archery bow sight apparatus is mounted to a bow, to provide a level indication while sighting through the circular bow sight housing.

17. A geared archery bow sight apparatus, comprising:

(a) a mounting frame member having a first linear slot, a second linear slot in spaced relation parallel to the first linear slot, an enlarged aperture sized to receive a convex fixed gear member therein, and an arcuate recess with a stepped ledge sized to receive a screw head therein, and at least one lightening hole extending through the mounting frame member to reduce the weight of the geared archery bow apparatus;

(b) a linear slide member with first and second bushings slidably received in the first linear slot of the mounting frame member, and a third bushing slidably received in the second linear slot, the first, second and third bushings made of a low friction material, the linear slide member with an elongated transverse aperture extending between the first and second bushings, and a plurality of apertures sized to receive a suitable fastening means therethrough;

(c) an articulated cam member with a first aperture sized to receive a pivot arm therethrough, the articulated cam member further having a cam bushing extending therefrom near a second end, the cam bushing sized to be closely received in the elongated transverse aperture extending into the linear slide member at assembly, the articulated cam member further having a rotatable geared sprocket extending therefrom, the rotatable geared sprocket sized to engage the fixed teeth of the convex fixed gear member secured within the enlarged aperture in the mounting frame member, and a pin extending from near the first end of the articulated cam member;

(d) a cylindrical handle connected to the geared sprocket through the articulated cam member, the cylindrical handle having an arcuate recess positioned to adjustably receive a locking knob therethrough, the cylindrical handle further having a knurled portion extending about the outer periphery of the cylindrical handle, with indicia located on an unknurled portion of the outer periphery of the cylindrical handle to align with the pin extending from the second end of the articulated cam member;

(e) an optical mounting bracket secured to the linear slide member; and a cylindrical bow site housing adjustably connected by a sliding keyway to a complimentary keyway located on the optical mounting bracket, with an adjustment screw to selectively position the cylindrical bow site housing in relation to the optical mounting bracket, with a fiber optic bow sight substantially centered within the cylindrical bow sight housing, and a fiber optic band extending about the outer periphery of the circular bow sight housing, the fiber optic band in optical communication with the fiber optic bow sight, to intensify the light transmitted by the fiber optic bow sight in low light conditions, and the cylindrical bow sight housing further with a circular ring element mounted on a front face of the circular bow sight housing, to provide a circular frame of reference about the fiber optic bow sight; wherein rotation of the cylindrical handle, rotates the geared sprocket in relation to the convex fixed gear member, which biases the articulated cam member to slidably bias the linear slide member and the optical mounting bracket, which acts to bias the circular bow sight housing to align the fiber optic sight, in relation to the distance of the geared bow sight apparatus from a remote target.

18. The geared bow sight apparatus of claim 17, wherein a leveling bubble is mounted on the upper portion of the circular bow sight housing when the geared archery bow sight apparatus is mounted to a bow, to provide a level indication while sighting through the circular bow sight housing.

19. The geared bow sight apparatus of claim 17, wherein a printed strip with indicia thereon is removably secured upon the outer circumference of the cylindrical handle, the indicia positioned on the printed strip to indicate the position required for a selected distance to a remote target.

20. The geared bow sight apparatus of claim 17, wherein the first guide bushing, the second guide bushing, the third guide bushing and the fourth guide bushing are each made of a low friction material, and wherein at least one lightening hole is provided in the mounting frame member to reduce weight; and the mounting frame member, the linear slide member, the articulated cam member and the optical mounting bracket are each made of a suitable aluminum material to further reduce weight.

* * * * *